US006744202B2

(12) United States Patent
Okigawa et al.

(10) Patent No.: US 6,744,202 B2
(45) Date of Patent: Jun. 1, 2004

(54) PLASMA DISPLAY PANEL WITH A MESH ELECTRODE HAVING PLURAL OPENINGS

(75) Inventors: Akifumi Okigawa, Tokyo (JP); Tetsuji Okajima, Tokyo (JP)

(73) Assignee: NEC Corporation, Tokyo (JP)

( * ) Notice: Subject to any disclaimer, the term of this patent is extended or adjusted under 35 U.S.C. 154(b) by 69 days.

(21) Appl. No.: 09/888,394

(22) Filed: Jun. 26, 2001

(65) Prior Publication Data

US 2001/0054872 A1 Dec. 27, 2001

(30) Foreign Application Priority Data

Jun. 27, 2000 (JP) ..... 2000-193052

(51) Int. Cl.[7] ..... H01J 17/49
(52) U.S. Cl. ..... 313/586; 313/582; 313/492
(58) Field of Search ..... 313/582–587, 313/491, 492, 495–497, 484, 485, 581, 348, 349, 352; 445/49, 50, 46

(56) References Cited

U.S. PATENT DOCUMENTS 5,640,068 A * 6/1997 Amemiya ..... 313/582
5,990,617 A * 11/1999 Kanae et al. ..... 313/582
6,111,357 A * 8/2000 Fleming et al. ..... 313/509
6,118,214 A * 9/2000 Marcotte ..... 313/582
6,333,599 B1 * 12/2001 Kawanami et al. ..... 313/582
6,384,531 B1 * 5/2002 Park et al. ..... 313/584
6,479,934 B2 * 11/2002 Nishio ..... 313/586
6,522,071 B1 * 2/2003 Park et al. ..... 313/582
2001/0024921 A1 * 9/2001 Hirano ..... 445/24

FOREIGN PATENT DOCUMENTS

| | | |
|---|---|---|
| JP | 8-22772 | 1/1996 |
| JP | 2734405 | 1/1998 |
| JP | A 2000-156167 | 8/2000 |
| KR | 0166009 | 12/1998 |

* cited by examiner

*Primary Examiner*—Nimeshkumar D. Patel
*Assistant Examiner*—German Colón
(74) *Attorney, Agent, or Firm*—Young & Thompson

(57) ABSTRACT

In order to provide an AC type plasma display panel having improved luminous efficiency, small power consumption and high luminance, sustaining electrodes (14*a*, 14*b*) of the AC type plasma display panel take in the form of mesh electrodes each having a plurality of openings (13). Each opening (13) is a strip-shaped opening having a size included in a rectangular area having one of sides thereof smaller than 30 $\mu$m or having a width smaller than 30 $\mu$m.

10 Claims, 13 Drawing Sheets

PLASMA DISPLAY PANEL WITH A MESH ELECTRODE HAVING PLURAL OPENINGS

BACKGROUND OF THE INVENTION

1. Field of the Invention

The present invention relates to an AC type plasma display panel, and more particularly to an electrode structure of a surface-discharge type plasma display panel.

2. Description of the Prior Art

A plasma display panel is classified into an AC type and a DC type and the AC type plasma display panel is further classified into a surface-discharge type and an opposed-discharge type.

A conventional surface-discharge type plasma display panel is shown in FIG. 12 and FIG. 13. As shown in FIG. 14, which is a cross section taken along a line A—A in FIG. 13, a front substrate 1 and a rear substrate 2 are arranged in an opposed relation so as to form a discharge space 10. The front and rear substrates 1 and 2 are formed of soda lime glass having thickness of 2 mm to 5 mm. A plurality of electrode pairs 3 each including transparent sustaining electrodes 3*a* and 3*b* of indium tin oxide are formed on the front substrate 1. To reduce electric resistance of the sustaining electrodes 3*a* and 3*b*, metal electrodes of silver or aluminum may be formed on the sustaining electrodes 3*a* and 3*b*, respectively. On the sustaining electrode pairs 3, a transparent dielectric layer 5 of low melting point glass is formed with thickness of 10 $\mu$m to 40 $\mu$m and then covered by an MgO protective film 8 having thickness of 0.5 $\mu$m to 2 $\mu$m.

A plurality of data electrodes 4 are formed on the rear substrate 2 and a white dielectric layer 6 is coated on the data electrodes 4. A phosphor layer 7 is then formed on the white dielectric layer 6.

The front substrate 1 and the rear substrate 2 are arranged in a mutually opposing relation in such a way that the electrode pairs 3 and the data electrodes 4 become orthogonal to each other, resulting in a plurality of cells 12. In the following description, a direction along which the data electrodes 4 extend will be referred to as "row direction" and a direction along which the electrode pairs 3 extend will be referred to as "line direction".

The discharge space 10 of each cell 12 is filled with mixed rare gas containing Xe gas at a pressure of 20 kPa to 80 kPa. The cells 12 are partitioned by barrier ribs 11 extending in the row direction. In a case where each cell has a longitudinal length (row direction) of 1.05 mm and a lateral length (line direction) of 0.35 mm, for example, the sustaining electrodes 3*a* and 3*b* each 300 $\mu$m to 450 $\mu$m wide and 0.1 $\mu$m to 2 $\mu$m thick are arranged with a discharge gap 9 of 50 $\mu$m to 300 $\mu$m therebetween.

A sustaining voltage is applied between the sustaining electrodes 3*a* and 3*b* to generate sustaining discharge in the discharge space 10. Electrons generated by this discharge collide with Xe atoms, so that Xe atoms are excited or ionized. Excited Xe atoms emit ultraviolet ray having wavelengths 147 nm and 150 nm to 190 nm in vacuum ultraviolet region and the phosphor layer 7 irradiated with the ultraviolet ray emits visible light. The visible light is derived through the MgO protective film 8, the transparent dielectric layer 5, the sustaining electrodes 3*a* and 3*b* and the front substrate 1, directly or after reflected by the white dielectric layer 6.

The generated sustaining discharge is automatically terminated after charges are accumulated on a surface of the dielectric layer. For example, in a case where a positive pulse voltage is applied to the sustaining electrodes 3*a* and a negative pulse voltage is applied to the sustaining electrodes 3*b*, electrons generated by the discharge are moved to the sustaining electrodes 3*a* and positive ions such as Xe+ are moved to the sustaining electrodes 3*b*, so that the discharge terminates after the surface of the transparent dielectric layer on the sustaining electrodes 3*a* is charged negative and the surface of the transparent dielectric layer on the sustaining electrodes 3*b* is charged positive.

In order to reduce power consumption of the AC drive, surface-discharge type plasma display panel, it is necessary to improve the luminous efficiency thereof to thereby reduce power consumed by discharge. In general, there is a tendency that the lower the discharge current density results in the higher the luminous efficiency of the AC type plasma display panel. It is possible to improve the luminous efficiency of the plasma display panel by reducing the voltage to be applied to the sustaining electrodes to thereby reduce the discharge current since, in the latter case, the discharge current density is lowered. However, when the sustaining voltage is lowered, the discharge becomes unstable and, therefore, a stable display operation becomes impossible.

On the other hand, it is possible to reduce electrostatic capacitance between the surface of the transparent dielectric layer and the sustaining electrodes when an area of each sustaining electrode is reduced by reducing the width thereof. In a case where the same sustaining voltage is applied to the sustaining electrodes each having reduced width, it is possible to reduce discharge current since an amount of charge accumulated on the surface of the transparent dielectric layer is reduced. In such case, however, since the area of the sustaining electrodes is reduced, the discharge current density is unchanged. Therefore, the luminous efficiency is not changed substantially.

When the area of the sustaining electrodes is reduced, discharge does not spread over the cells, so that only a portion of the phosphor layer may emit light. As a result, luminance is lowered and it is impossible to obtain an acceptable image quality.

JP H08-22772A discloses a technique for improving luminous efficiency by using sustaining electrodes each including a main portion extending in a line direction and a protruded portion protruding from the main portion and having a narrowed portion. In this prior art, power consumption is reduced by reducing discharge current of each cell by the narrowed portion. In this prior art, however, there may be a case where luminance is reduced since discharge is concentrated in the vicinity of the narrowed portion and does not spread over the cells.

On the other hand, Japanese Patent No. 2734405 discloses a technique for reducing peak value of discharge current by providing an opening in each of sustaining electrodes arranged along a plurality of rows such that discharge current includes a plurality of peaks. However, in this prior art in which peaks of discharge current are separated, discharge current density is substantially equal to that of the conventional structure since the relatively large opening is formed in each sustaining electrode. Consequently, it is impossible to improve luminous efficiency.

SUMMARY OF THE INVENTION

Accordingly, an object of the present invention is to provide an AC type plasma display panel having improved luminous efficiency, improved luminance and small power consumption.

To achieve the above object, an AC type plasma display panel according to the present invention, which has electrodes formed on a substrate thereof and a dielectric layer covering the electrodes, is featured by that each of the electrodes is a mesh electrode having a plurality of openings and each opening has such size as included within a rectangular area having either side equal to or larger than 5 μm and shorter than 30 μm or has a strip shape having width equal to or larger than 5 μm and shorter than 30 μm.

In the present invention, a voltage signal for sustaining discharge is applied to the mesh electrodes and discharge is generated in a discharge space. Due to the use of the mesh sustaining electrodes each having a plurality of openings, an area of the sustaining electrode is reduced compared with the conventional structure and discharge current is reduced. Since, in the present invention, the size of the opening is as small as Debye length of discharge plasma, amounts of various physical factors featuring the discharge structure, such as electron density, ionization rate, excitation rate, etc., are not changed drastically. In such case, it is possible to uniformly reduce discharge current density spatially regardless of configuration of the opening.

Such effect can be obtained provided that the opening has the size included in a rectangular area having either side length in the order of Debye length of plasma or has a strip-shaped configuration having width in the order of Debye length. As a result, discharge current density is reduced and the luminous efficiency is improved. On the other hand, discharge spreads along the mesh electrode to cover the whole cell, resulting in sufficient luminance. Therefore, the AC type plasma display panel having improved luminous efficiency, improved luminance and low power consumption is realized.

DETAILED DESCRIPTION OF THE PREFERRED EMBODIMENTS

Figure 1:
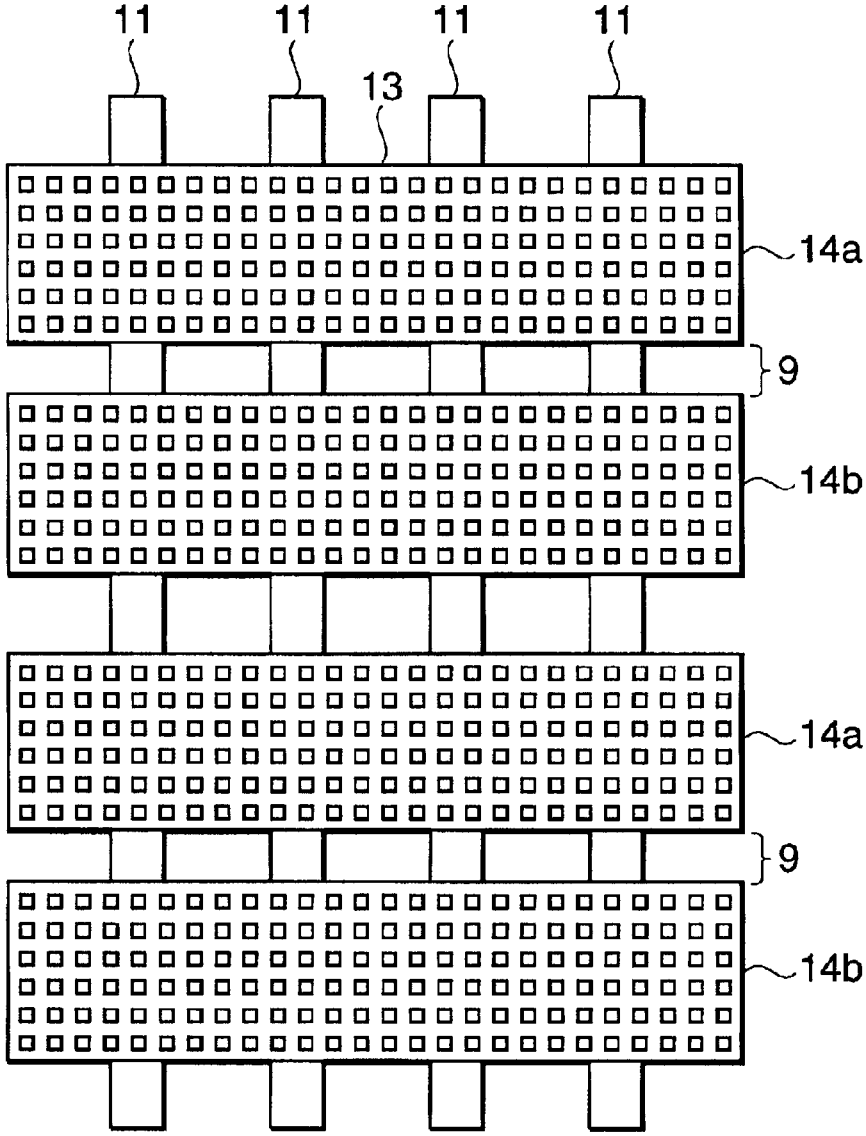
FIG. 1 is a plan view showing a pattern of openings of a sustaining electrode according to a first embodiment of the present invention.
Figure 13:
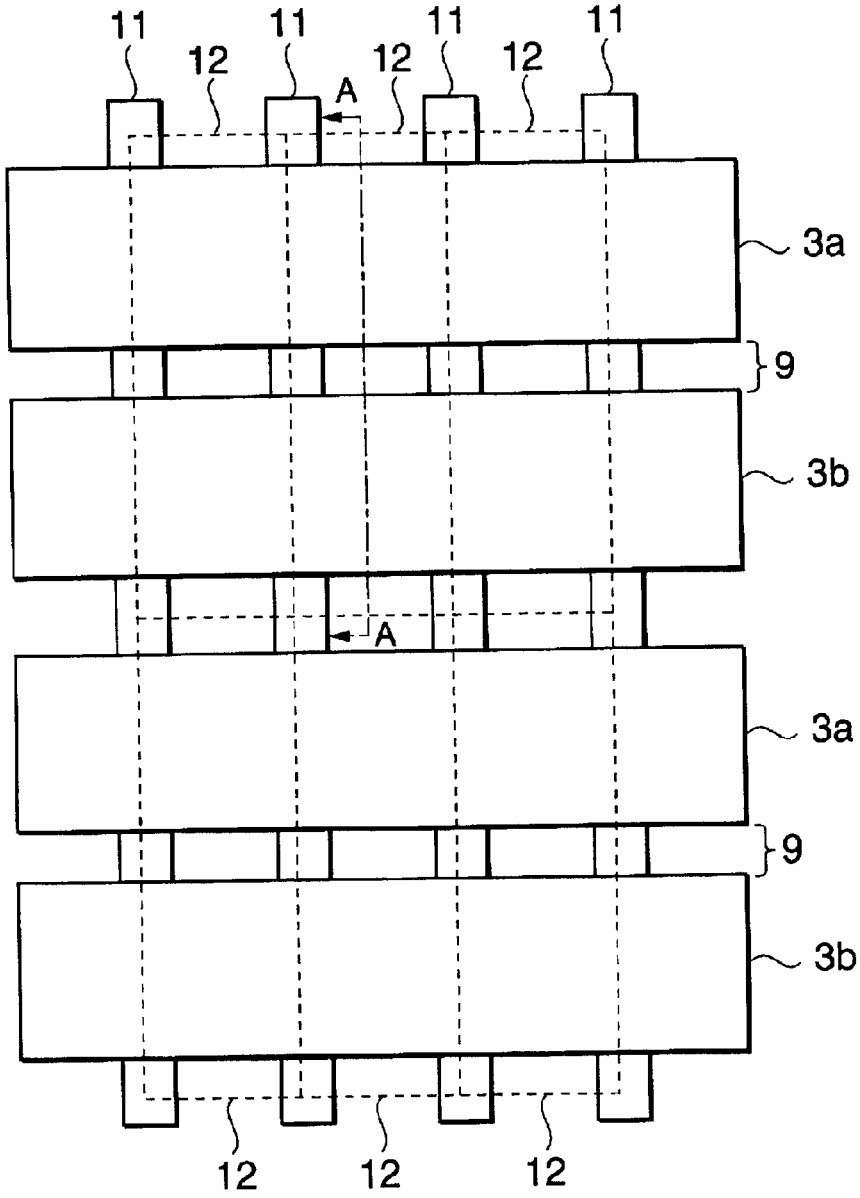
FIG.13 PRIOR ART
FIG. 13 is a plan view of a conventional sustaining electrode.
Figure 14:
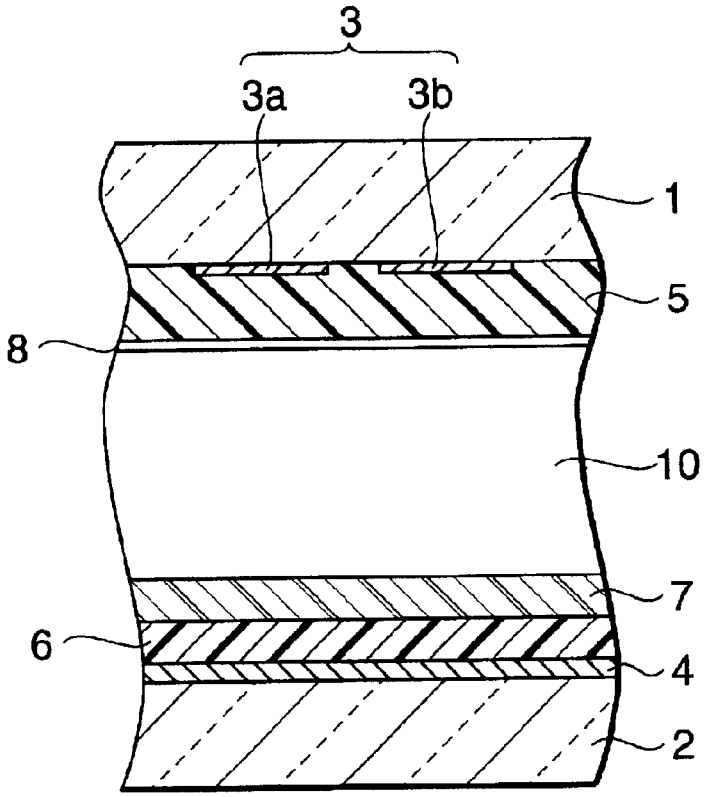
FIG.14 PRIOR ART
FIG. 14 is a cross section taken along a line A—A in FIG. 13.

FIG. 1 is a plan view showing a pattern of openings of a sustaining electrode according to a first embodiment of the present invention and corresponds to the conventional plasma display panel shown in FIG. 13. In FIG. 1, regions similar to those shown in FIG. 13 are depicted by the same reference numerals, respectively. The first embodiment shown in FIG. 1 differs from the conventional structure of the plasma display panel shown in FIG. 13 in that mesh sustaining electrodes 14*a* and 14*b* each having a number of minute openings 13 are used instead of the transparent electrodes shown in FIG. 13.

A voltage signal for sustaining discharge is applied to the mesh electrodes 14*a* and 14*b* as the sustaining electrodes, so that plasma is generated in a discharge space 10. With the use of the mesh electrodes each having a number of openings, an area of the sustaining electrodes is reduced compared with the electrode area of the conventional structure, so that discharge current is reduced. In the present invention, the size of the opening is as small as in the order of Debye length of plasma. Debye length is a measure of charge separation and depends on electron temperature and electron density. Debye length when electron temperature is 1 eV to 3 eV and electron density is $10^{11}$~$10^{12}$ $cm^{-3}$ is 7~41 μm. Since the size of the opening is in the order of Debye length, there is no case where electron density on the opening is substantially different from electron density on the transparent electrode surrounding the opening.

By forming such openings in each transparent electrode, it is possible to uniformly reduce discharge current density on the openings and the area surrounding the openings, regardless of configuration of the opening. As a result of the reduction of discharge current density, luminous efficiency is improved. On the other hand, since discharge spreads along the mesh electrodes 14*a* and 14*b* such that the whole cells are covered thereby, ultraviolet ray excites a phosphor layer of the cells, so that it is possible to obtain high luminance. Therefore, it is possible to obtain an AC type plasma display panel having improved luminous efficiency, high luminance and small power consumption.

Figure 2:
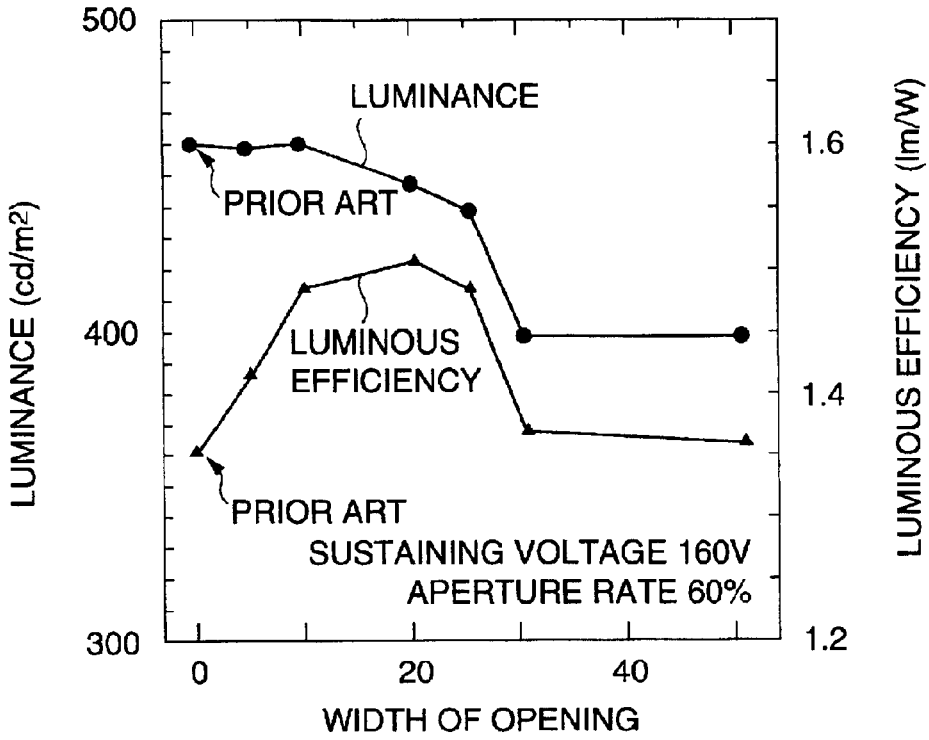
FIG. 2 is a graph showing a dependency of luminance and luminous efficiency on width of the opening.

FIG. 2 is a graph showing a relation between the width of the opening and luminous efficiency as well as luminance under condition of sustaining voltage of 160V and aperture rate of 60%. In FIG. 2, the width of the opening is defined as a shorter side length or longer side length of a minimum rectangular including the opening or a width of a strip-shaped opening. Luminous efficiency when the width of the opening is equal to or larger than 5 μm and smaller than 30 μm is higher than that of the conventional structure at a portion in which the width of opening is 0 μm and luminance is substantially equal to that of the conventional structure. When the width of opening is equal to or larger than 30 μm, luminous efficiency is slightly higher than that of the conventional structure although luminance is substantially reduced. Therefore, when the width of opening is equal to or larger than 5 μm and smaller than 30 μm, particularly, in a range from 10~25 μm, luminance is high and the effect of improvement of luminous efficiency is high. Furthermore, it has been found that the improvement of luminous efficiency is substantial when the width of opening is in a range of 0.2 to 1.8 times the thickness of the transparent dielectric layer.

Figure 3:
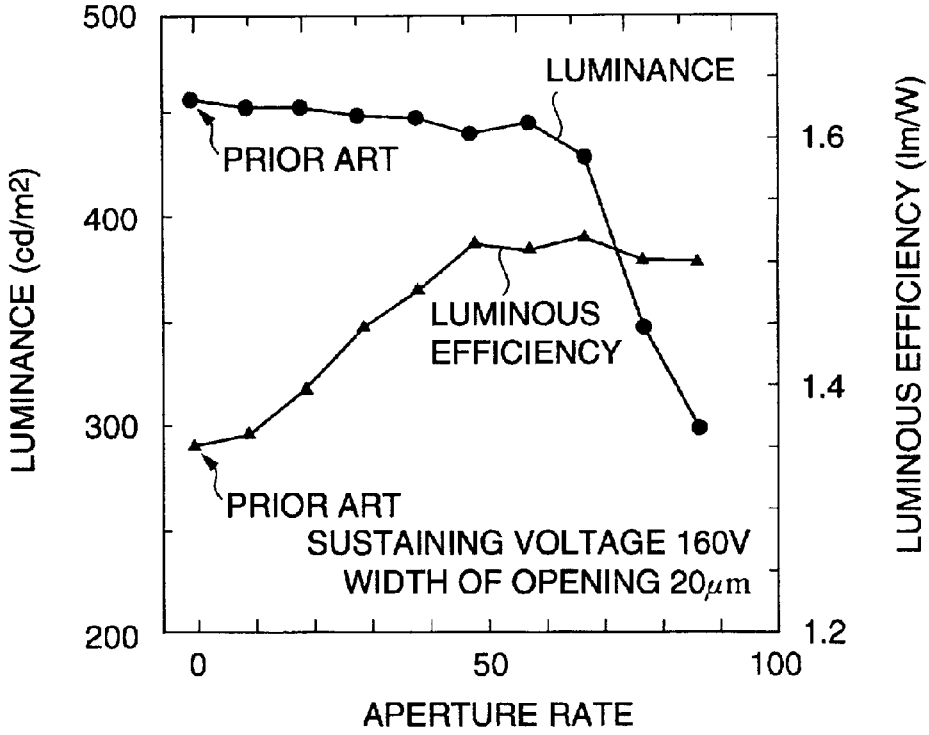
FIG. 3 is a graph showing a dependency of luminance and luminous efficiency on aperture rate.

FIG. 3 is a graph showing a relation between the aperture rate and luminous efficiency as well as luminance under condition of sustaining voltage of 160V and width of opening of 20 μm. In FIG. 3, the aperture rate defines a ratio of a total area of the openings to a sum of the total area of the openings and a total area of the sustaining electrodes. When aperture rate is 10% or more, luminous efficiency becomes higher than that of the conventional structure at a portion in which the aperture rate is 0% and, when aperture rate is 70% or less, there is no reduction of luminance. Therefore, it is preferable that aperture rate is from 10% to 70%. Particularly, aperture rate is more preferably in a range from 30% to 60%, in which both the luminance and luminous efficiency are improved.

Figure 4:
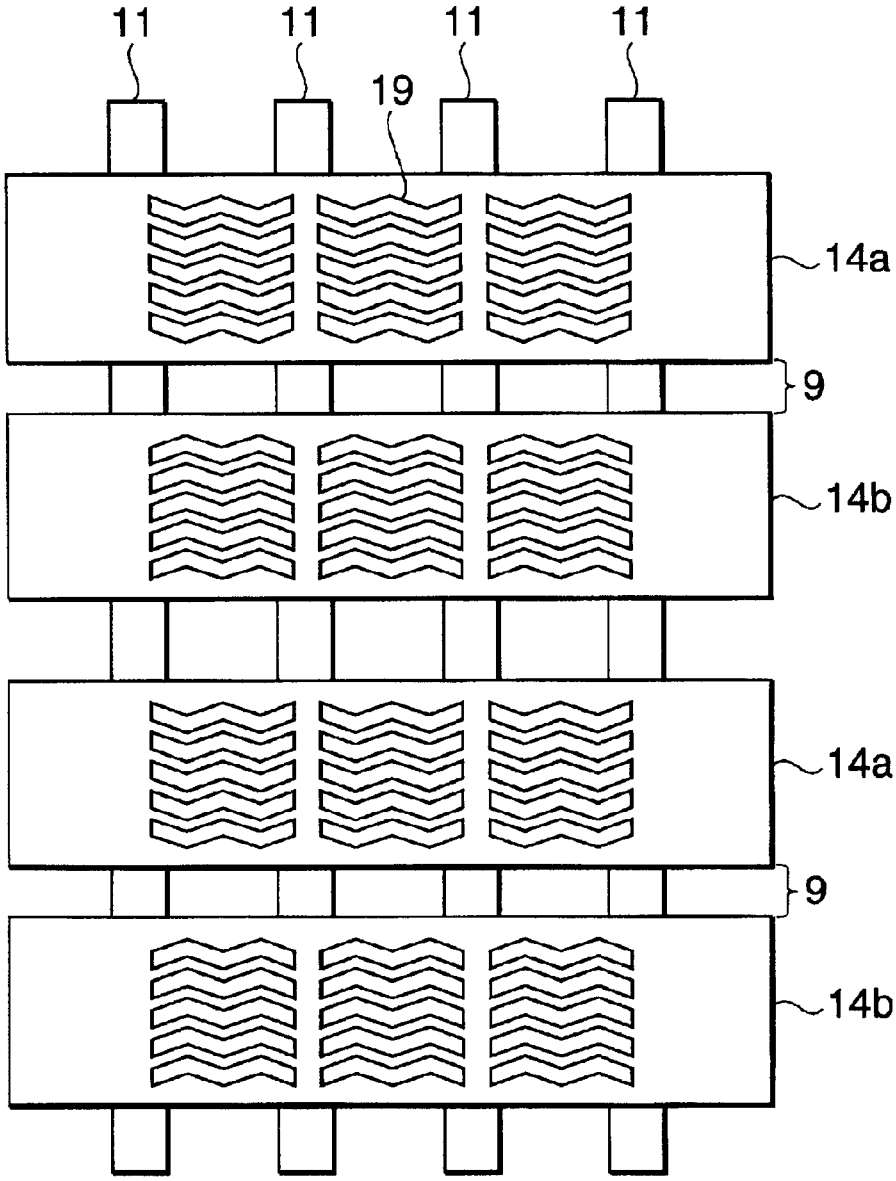
FIG. 4 is a plan view showing a pattern of openings of a sustaining electrode according to a second embodiment of the present invention.
Figure 5:
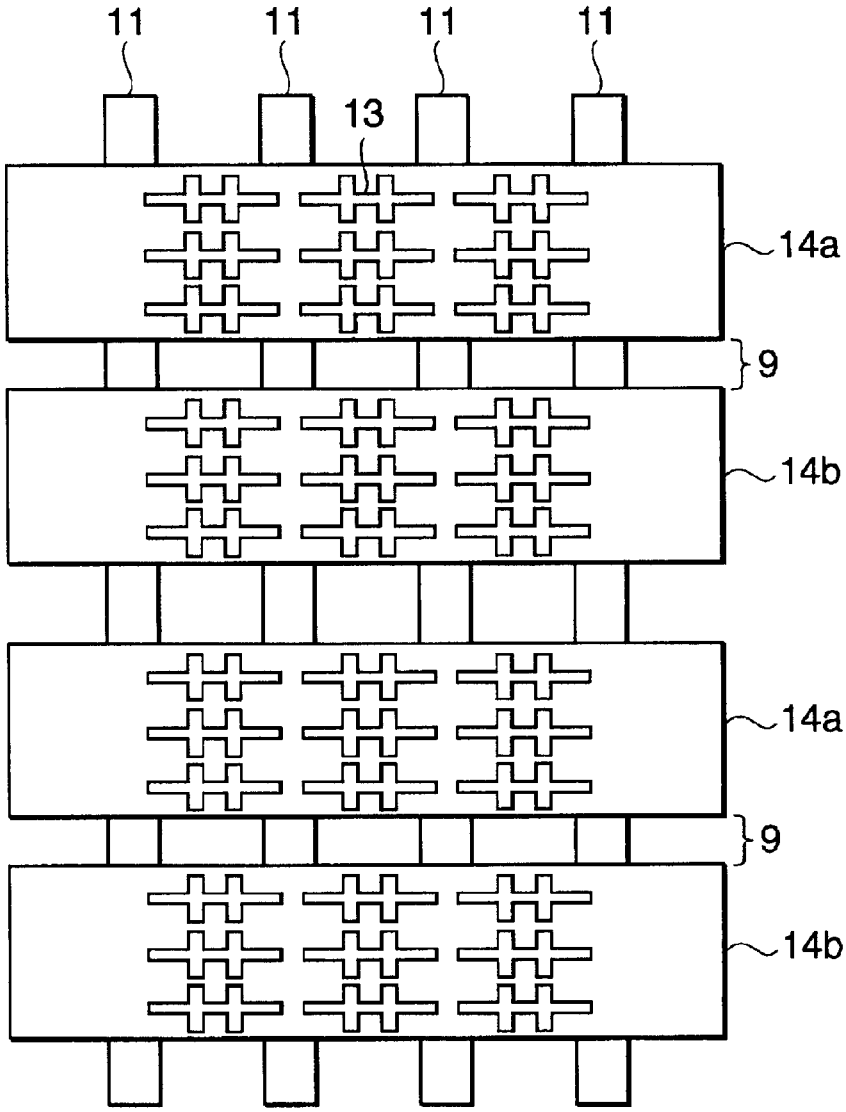
FIG. 5 is a plan view showing a pattern of openings of a sustaining electrode according to a third embodiment of the present invention.

The configuration of the opening is not limited to square. Circular or triangular opening may be used. Furthermore, the opening may have a zigzag strip-shaped configuration as shown in FIG. 4 showing a second embodiment of the present invention. When width of the zigzag strip-shaped opening is equal to or larger than 5 μm and smaller than 30 μm, luminance is high and luminous efficiency is improved. Alternatively, the configuration of the opening may be one which is a combination of a plurality of square openings each having with of a value equal to or larger than 5 μm and smaller than 30 μm, as shown in FIG. 5 showing a third embodiment of the present invention.

Figure 6:
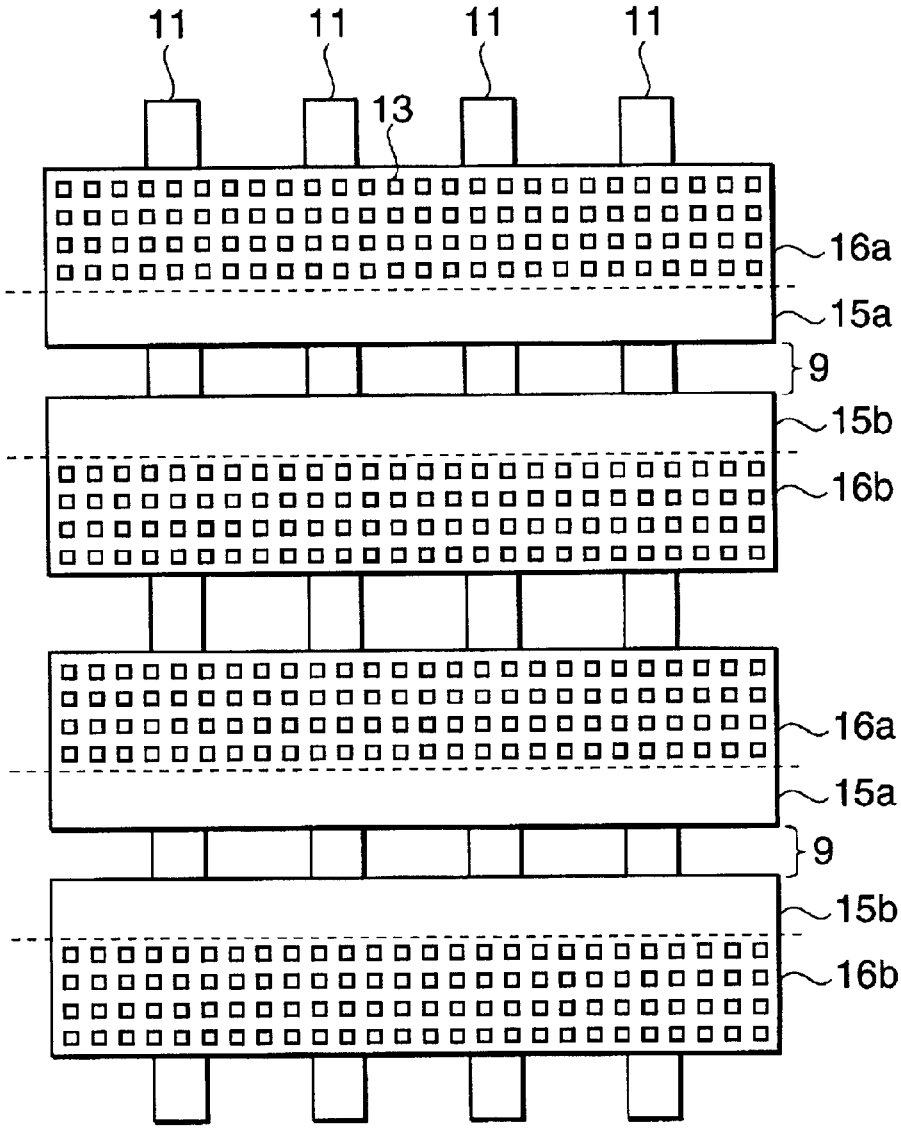
FIG. 6 is a plan view showing a pattern of openings of a sustaining electrode according to a fourth embodiment of the present invention.

FIG. 6 is a plan view of an AC type plasma display panel of the surface-discharge type according to a fourth embodiment of the present invention. In FIG. 6, each sustaining electrode pair is constructed with first strip-shaped areas 15*a* and 15*b* on the side of a discharge gap 9 and second strip-shaped areas 16*a* and 16*b* on the side of non-discharge gap. The first areas 15*a* and 15*b* are transparent electrodes having no opening and the second areas 16*a* and 16*b* are transparent mesh electrodes each having a number of openings. When a number of openings are formed in a portion of the sustaining electrode close to the discharge gap, there may be a case where discharge voltage is increased or discharge becomes unstable. By providing the areas having no opening on the side of the discharge gap as in the present invention, it is possible to prevent increase of the discharge voltage and to generate stable discharge. In order to prevent increase of the discharge voltage and generate stable discharge, width of the first area on the side of discharge gap is preferably in a range from 25 μm to 100 μm. In this embodiment, when width of the opening is in a range from a value equal to or larger than 5 μm to a value smaller than 30 μm, particularly, in a range from 10 μm to 25 μm, luminance is high and an improvement of luminous efficiency is substantial. The width of opening is preferably in a range 0.2 to 1.8 times the thickness of the transparent dielectric layer. Furthermore, it is preferable that the aperture rate is in a range from 10% to 70%.

A fifth embodiment of the present invention, which is effective to make discharge stability high and simultaneously improve luminance and luminous efficiency, will be described.

Figure 7:
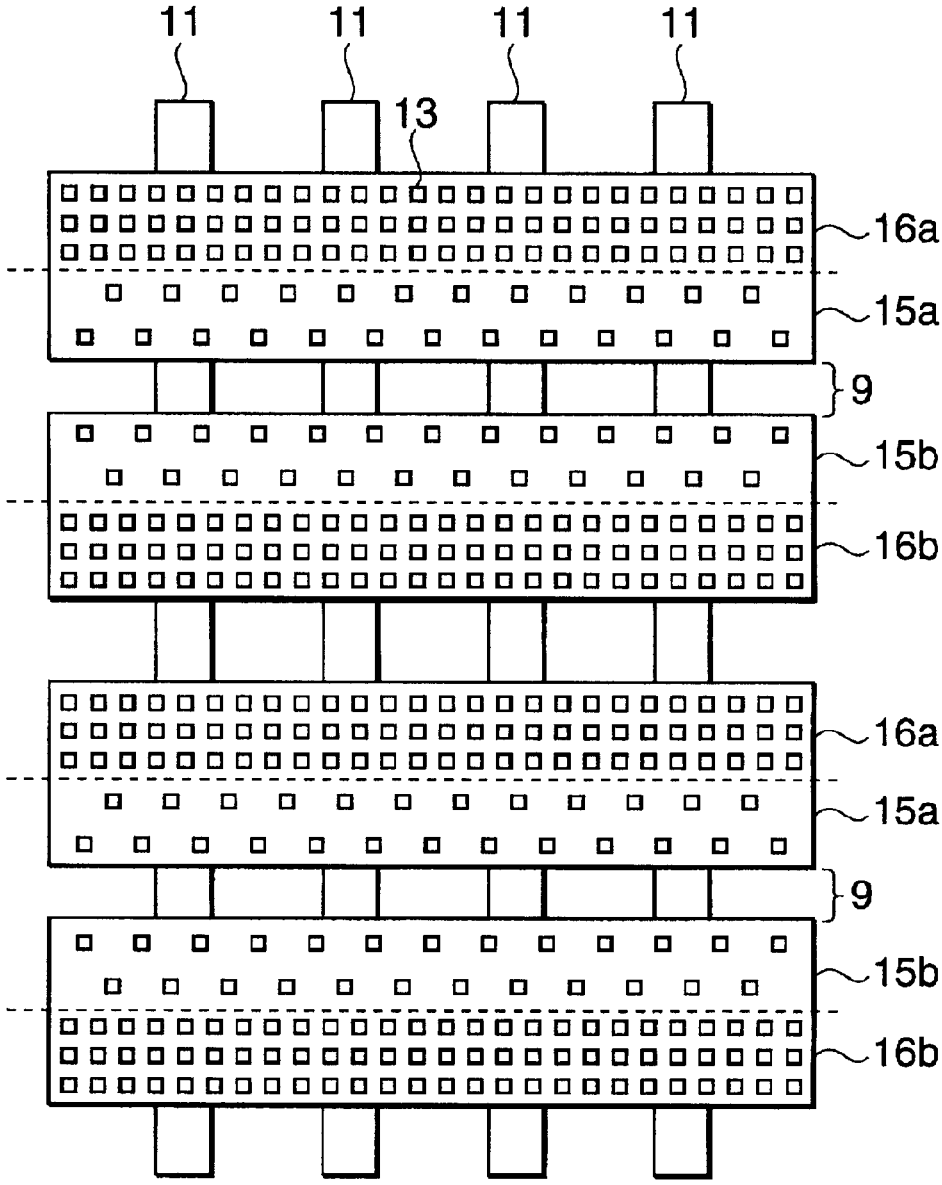
FIG. 7 is a plan view showing a pattern of openings of a sustaining electrode according to a fifth embodiment of the present invention.

FIG. 7 is a plan view of an AC type plasma display panel of the surface-discharge type, according to the fifth embodiment. In this embodiment, each sustaining electrode pair is constructed with first strip-shaped areas 15*a* and 15*b* on the side of a discharge gap 9 and second strip-shaped areas 16*a* and 16*b* on the side of non-discharge gap. The first areas 15*a* and 15*b* are transparent electrodes having a plurality of roughly arranged openings and the second areas 16*a* and 16*b* are transparent mesh electrodes each having a number of densely arranged openings. By increasing the number of the openings of the sustaining electrode, such that the closer portion of the sustaining electrode to the discharge gap has the smaller the ratio of a total area of the openings formed in that portion to a total area of the sustaining electrode, it is possible to obtain the stability of discharge and improve luminous efficiency.

Figure 8:
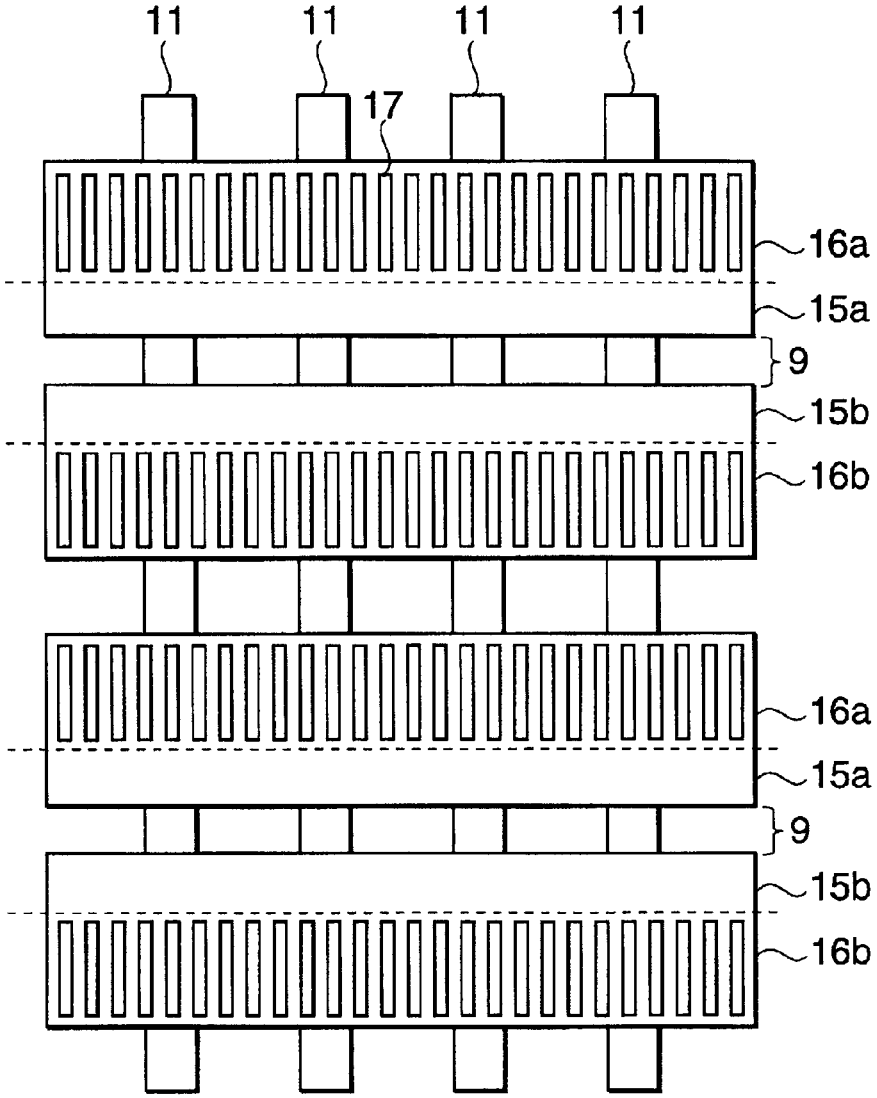
FIG. 8 is a plan view showing a pattern of openings of a sustaining electrode according to a sixth embodiment of the present invention.

FIG. 8 is a plan view of an AC type plasma display panel of the surface-discharge type, according to the sixth embodiment. In this embodiment, each sustaining electrode pair is constructed with the first strip-shaped areas 15*a* and 15*b* on the side of a discharge gap 9 and second strip-shaped areas 16*a* and 16*b* on the side of non-discharge gap. The first areas 15*a* and 15*b* are transparent electrodes having no openings and the second areas 16*a* and 16*b* are mesh transparent electrodes each having a number of rectangular openings 17 having longer side axises extending in parallel in the row direction. In general, in a case of high-resolution display, the cell pitch tends to become small, so that interference of discharge between adjacent cells may become a problem. Furthermore, it is general that, when discharge spreads transversely of the openings, the spreading speed of discharge becomes lowered. Therefore, by providing the openings extending in the row direction, discharge becomes difficult to spread in the line direction, so that it becomes possible to prevent the interference of discharge to the cells adjacent in the line direction. Simultaneously therewith, it becomes possible to improve luminance as well as luminous efficiency.

Figure 9:
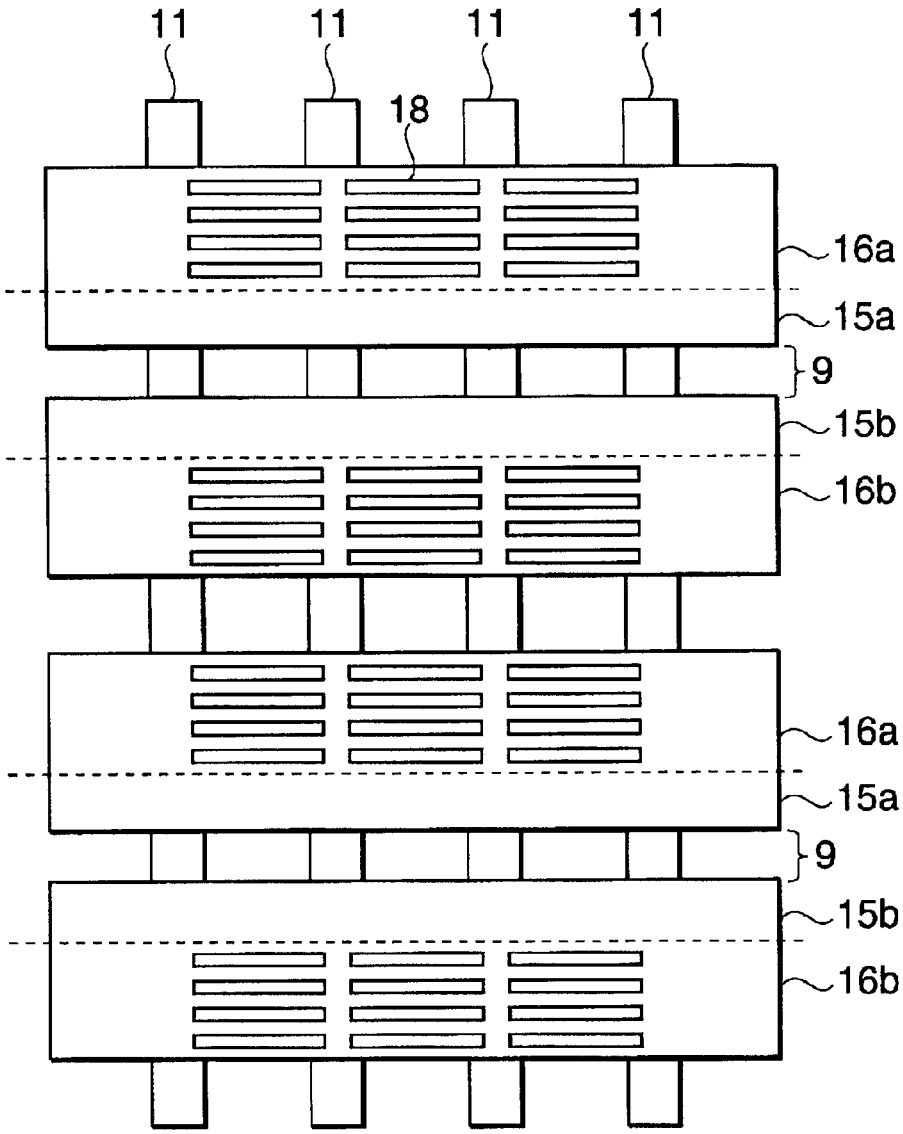
FIG. 9 is a plan view showing a pattern of openings of a sustaining electrode according to a seventh embodiment of the present invention.

FIG. 9 is a plan view of an AC type plasma display panel of the surface-discharge type, according to the seventh embodiment. In this embodiment, each sustaining electrode pair is constructed with the first strip-shaped areas 15*a* and 15*b* on the side of a discharge gap 9 and the second strip-shaped areas 16*a* and 16*b* on the side of non-discharge gap. The first areas 15*a* and 15*b* are transparent electrodes having no openings and the second areas 16*a* and 16*b* are transparent mesh electrodes each having a number of rectangular openings 18 having longer side axises extending in parallel in the line direction. Furthermore, opposite end portions of each opening 18 are positioned on the barrier ribs 11. With using the openings 18 having the described configuration, the spread of discharge in the row direction becomes difficult, so that it becomes possible to prevent the interference of discharge to the cells adjacent in the row direction.

Figure 10:
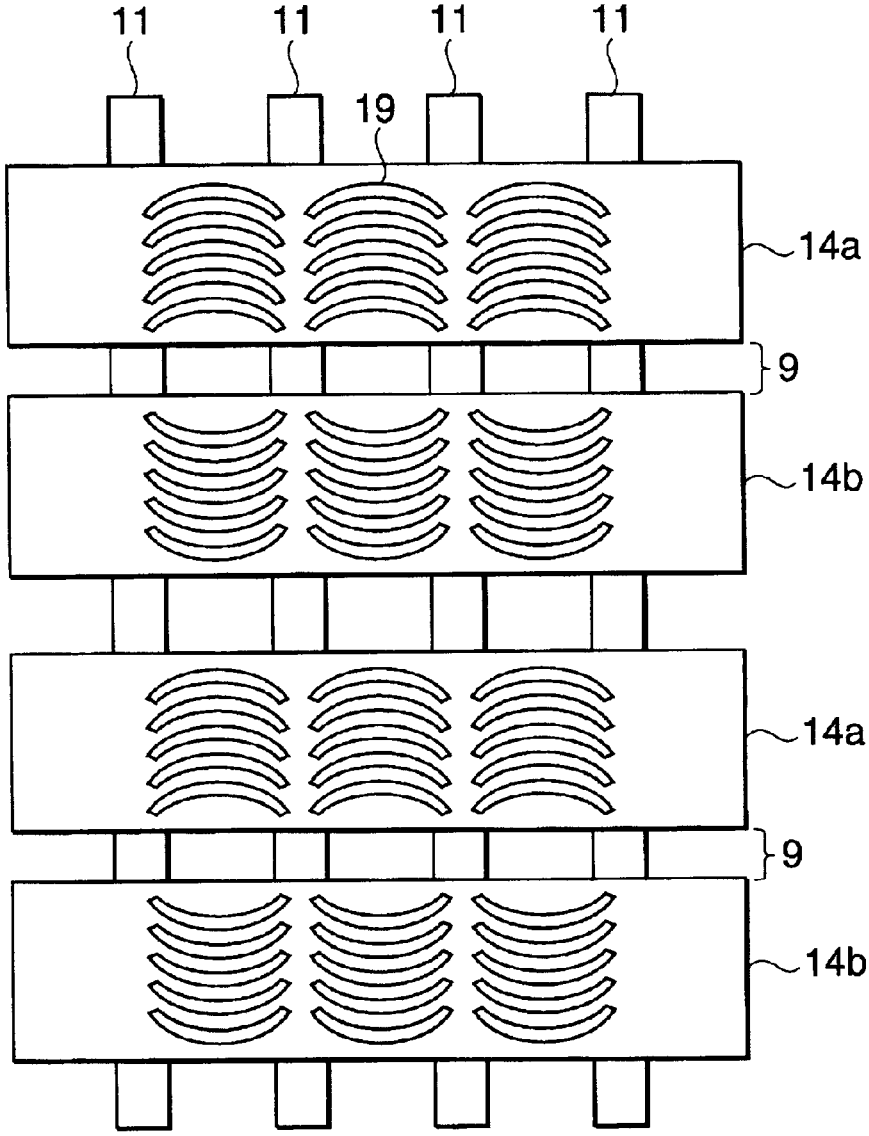
FIG. 10 is a plan view showing a pattern of openings of a sustaining electrode according to an eighth embodiment of the present invention.

FIG. 10 is a plan view of an AC type plasma display panel of the surface-discharge type, according to the eighth embodiment, which is effective in restricting discharge interference. In this embodiment, each sustaining electrode pair is constructed with strip-shaped mesh electrodes 14*a* and 14*b* each having a plurality of warped openings 19. The warping of the opening is convex in a direction away from the discharge gap 9. In this embodiment, discharge hardly spreads both in the line and row directions and it becomes possible to prevent the interference of discharge to the adjacent cells and, simultaneously therewith, it becomes possible to improve luminance as well as luminous efficiency.

Figure 11:
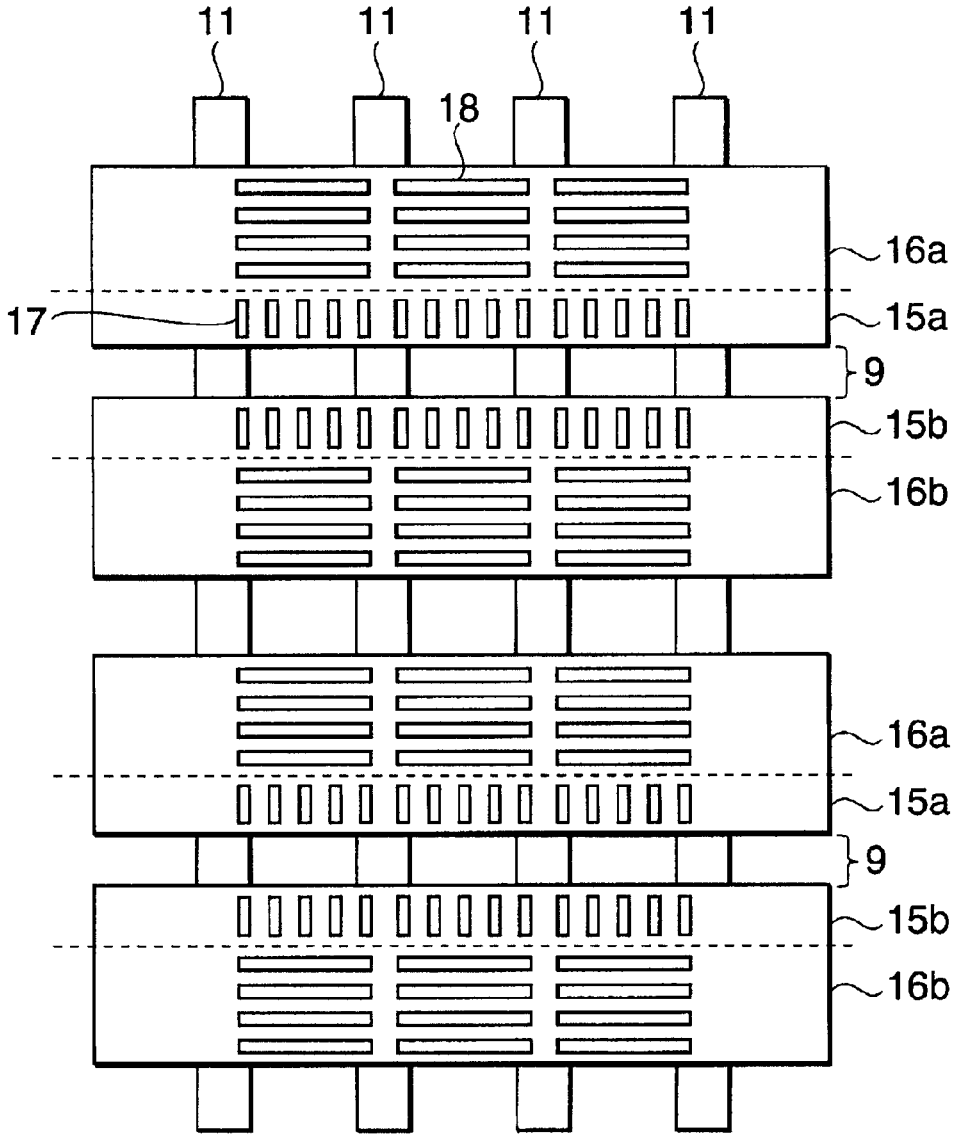
FIG. 11 is a plan view showing a pattern of openings of a sustaining electrode according to a ninth embodiment of the present invention.
Figure 12:
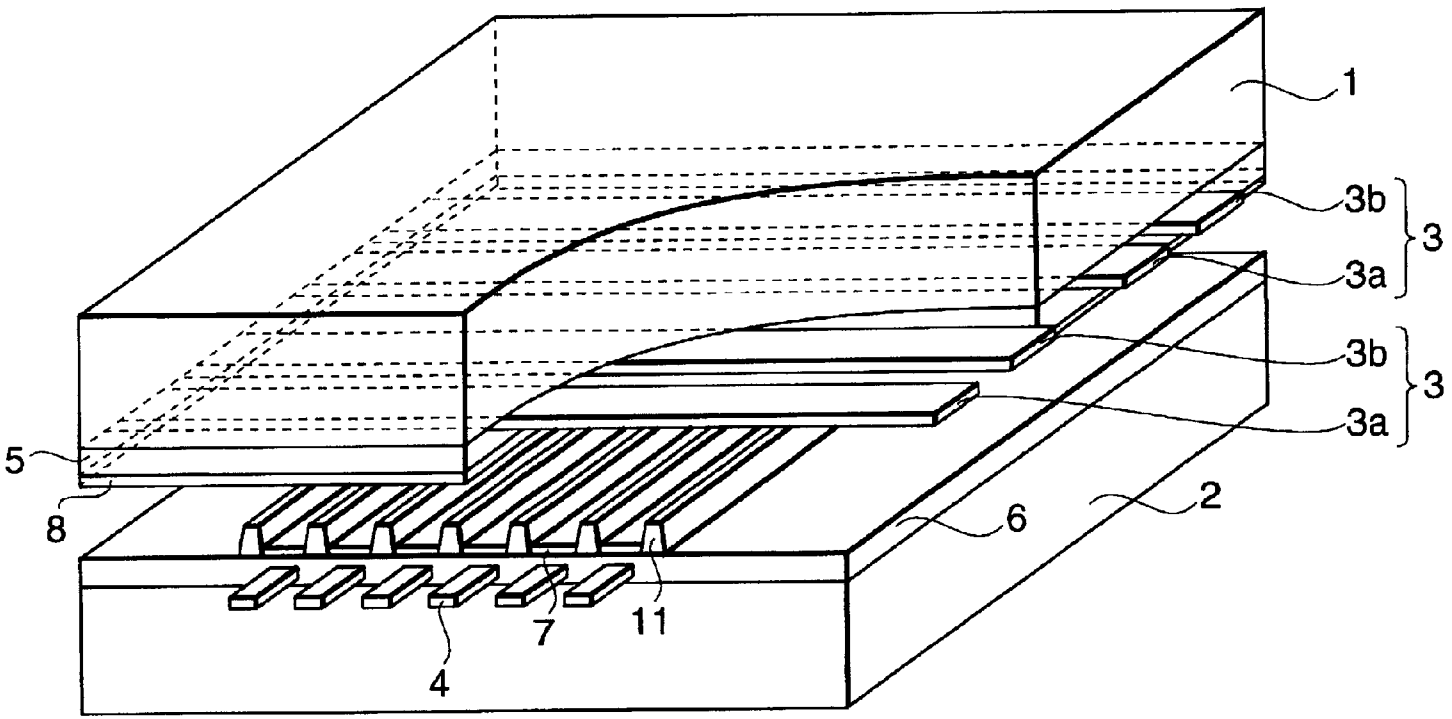
FIG.12 PRIOR ART
FIG. 12 is a perspective view of a conventional AC type plasma display panel of surface-discharge type.

FIG. 11 is a plan view of an AC type plasma display panel of the surface-discharge type, according to the ninth embodiment. In this embodiment, each sustaining electrode pair is constructed with the first area 15*a* having a plurality of openings 17 extending in the row direction and the second area 16*a* having a plurality of openings 18 extending in the line direction. The openings 17 extending in the row direction and the openings 18 extending in the line direction are combined in order to prevent the interference of discharge to the adjacent cells. Discharge is strongest in positions of centers of the cells in the vicinity of the discharge gap. Therefore, the radially outward spread of discharge from the center of the cell becomes difficult, so that the interference of discharge to the adjacent cells can be restricted sufficiently.

According to the present invention, an AC type plasma display panel of the surface-discharge type having high luminous efficiency and high luminance can be obtained.

What is claimed is:

1. An AC type plasma display panel comprising:

a first substrate having first electrodes and a dielectric layer covering said first electrodes;

a second substrate arranged in an opposed relation to said first substrate to form a discharge space therebetween;

discharge gas filled in said discharge space;

second electrodes formed on said second substrate, each said second electrode having a plurality of openings each having a size included by a rectangular area having length of one of two sides thereof in a range from a value equal to or larger than 5 $\mu$m to a value smaller than 30 $\mu$m; and a dielectric layer covering said second electrodes, wherein each said opening has a width in a range from a value equal to or larger than 5 $\mu$m to a value smaller than 30 $\mu$m and has a strip-shaped configuration, and wherein a width of said strip-shaped opening is in a range from 0.2 times to 1.8 times a thickness of said dielectric layer.

2. An AC type plasma display panel comprising:

a first substrate having first electrodes and a dielectric layer covering said first electrodes;

a second substrate arranged in an opposed relation to said first substrate to form a discharge space there between;

discharge gas filled in said discharge space;

second electrodes formed on said second substrate, each said second electrode having a plurality of openings each having a size included by a rectangular area having length of one of two sides thereof in a range from a value equal to or larger than 5 $\mu$m to a value smaller than 30 $\mu$m; and a dielectric layer covering said second electrodes wherein each said opening has a configuration including a combination of a plurality of openings having different configurations.

3. An AC type plasma display panel as claimed in claim 2, wherein a length of a shorter side of said opening is in a range from 0.2 times to 1.8 times a thickness of said dielectric layer.

4. An AC type plasma display panel comprising:

a first substrate having first electrodes and a dielectric layer covering said first electrodes;

a second substrate arranged in an opposed relation to said first substrate to form a discharge space therebetween;

discharge gas filled in said discharge space;

second electrodes formed on said second substrate, each said second electrode having a plurality of openings each having a size included by a rectangular area having length of one of two sides thereof in a range from a value equal to or larger than 5 $\mu$m to a value smaller than 30 $\mu$m; and a dielectric layer covering said second electrodes wherein each said second electrode includes a pair of parallel electrodes to generate a surface-discharge, each said parallel electrode pair is constructed by a first area along a discharge gap formed between said pair of parallel electrodes and a second area other than said first area, said first area is 25~100 $\mu$m wide and said openings are formed in only said second area.

5. An AC type plasma display panel as claimed in claim 4, wherein said openings are arranged in said second area in a row direction.

6. An AC type plasma panel as claimed in claim 4, wherein said openings are arranged in said second area in a line direction.

7. An AC type plasma display panel comprising:

a first substrate having first electrodes and a dielectric layer covering said first electrodes;

a second substrate arranged in an opposed relation to said first substrate to form a discharge space therebetween;

discharge gas filled in said discharge space;

second electrodes formed on said second substrate, each said second electrode having a plurality of openings each having a size included by a rectangular area having length of one of two sides thereof in a range from a value equal to or larger than 5 $\mu$m to a value smaller than 30 $\mu$m; and a dielectric layer covering said second electrodes wherein each said second electrode includes a pair of parallel electrodes to generate a surface-discharge, each said parallel electrode pair is constructed by a first area along a discharge gap formed between said pair of parallel electrodes and a second area other than said first area and a ratio of a total area of said openings formed in said first area to an area of said first area is smaller than a ratio of a total area of said openings formed in said second area to an area of said second area.

8. An AC type plasma display panel comprising:

a first substrate having first electrodes and a dielectric layer covering said first electrodes;

a second substrate arranged in an opposed relation to said first substrate to form a discharge space there between;

discharge gas filled in said discharge space;

second electrodes formed on said second substrate, each said second electrode having a plurality of openings each having a size included by a rectangular area having length of one of two sides thereof in a range train a value equal to or larger than 5 $\mu$m to a value smaller than 30 $\mu$m; and a dielectric layer covering said second electrodes wherein each said second electrode includes a pair of parallel electrodes to generate a surface-discharge, each said second electrode is constructed with a plurality of strip-shaped areas and the smaller the ratio of a total area of said openings formed in said strip-shaped area to an area at said strip-shaped area is the closer the strip-shaped area to the discharge gap.

9. An AC type plasma display panel comprising:

a first substrate having first electrodes and a dielectric layer covering said first electrodes;

a second substrate arranged in an opposed relation to said first substrate to form a discharge space therebetween;

discharge gas filled in said discharge space;

second electrodes formed on said second substrate, each said second electrode having a plurality of openings each having a size included by a rectangular area having length of one of two sides thereof in a range from a value equal to or larger than 5 $\mu$m to a value smaller than 30 $\mu$m; and a dielectric layer covering said second electrodes wherein each said second electrode includes a pair of parallel electrodes to generate a surface-discharge, each said parallel electrode pair is constructed by a first area along a discharge gap and a second area other than said first area, said openings are arranged in said first area in a row direction and said openings are arranged in said second area in a line direction.

10. An AC type plasma display panel as claimed in claim 9, wherein a ratio of a total area of said openings formed in said second area to a sum of an area of said second electrode and the total area of said openings is in a range from 10% to 70%.

* * * * *